United States Patent [19]

Bernardis et al.

[11] 4,285,603

[45] Aug. 25, 1981

[54] WIRE PRINTING DEVICE

[75] Inventors: Francesco Bernardis, Ivrea; Contardo Adamoli, Castellamonte; Franco Cretaz, Pont Saint Martin, all of Italy

[73] Assignee: Ing. C. Olivetti & C., S.p.A., Italy

[21] Appl. No.: 30,950

[22] Filed: Apr. 17, 1979

[30] Foreign Application Priority Data

Apr. 19, 1978 [IT] Italy ..... 67885 A/78

[51] Int. Cl.[3] ..... B41J 3/12

[52] U.S. Cl. ..... 400/124; 101/93.05; 335/258

[58] Field of Search ..... 400/124; 101/93.05; 335/258

[56] References Cited

U.S. PATENT DOCUMENTS

| | | | |
|---|---|---|---|
| 3,940,726 | 2/1976 | Gershnow | 400/124 |
| 3,948,382 | 4/1976 | Nesbitt et al. | 400/124 X |
| 4,010,836 | 3/1977 | Bernardis et al. | 400/124 |
| 4,034,841 | 7/1977 | Ohyama et al. | 400/124 |
| 4,091,909 | 5/1978 | Lee | 101/93.05 X |

*Primary Examiner*—Paul T. Sewell

*Attorney, Agent, or Firm*—Schuyler, Banner, Birch, McKie & Beckett

[57] ABSTRACT

A wire printing device comprises a plurality of printing wires, each one associated with a corresponding driving electromagnet and a frame which is constituted by a plate folded in order to have a central portion, on which are mounted the electromagnets, and a pair of tongues which support guide elements for the printing wires. The gap between armature and core of each electromagnet can be regulated by a screwable element which determines the stroke of the armature and of the associated wire.

5 Claims, 3 Drawing Figures

WIRE PRINTING DEVICE

BACKGROUND OF THE INVENTION

The present invention refers to a wire printing device comprising a plurality of printing wires, each associated with a corresponding driving electromagnet, a frame on which said electromagnets are mounted and a guiding element for said wires.

In wire printing devices known from the prior art, the frame supporting the electromagnets is usually constituted by a rather complex piece, almost always obtained by fusion, upon which suitable seats for the element guiding the printing wires are fixed. Such devices therefore have the drawback of being rather heavy and of requiring rather complex and cumbersome devices for sliding them along the printing line. Moreover, such devices are also rather expensive owing to the precision with which each single piece must be manufactured and subsequently assembled with the rest.

SUMMARY OF THE INVENTION

The object of the present invention is to provide a very simple, light and cheap wire printing device.

According to the present invention, there is provided a wire printing device wherein the frame is constituted by a plate folded so as to have a central portion on which said electromagnets are mounted, and by at least one tongue supporting the guiding element.

BRIEF DESCRIPTION OF THE DRAWING

This and other characteristics of the present invention will be clear from the following description of a preferred embodiment, made by way of example and not intented to be limiting, with the aid of the attached drawings, in which:

With reference to FIG. 1, the wire printing device according to the invention comprises a base member or frame 10 constituted by a single laminated metallic plate having a substantially constant thickness (FIG. 2), folded and shaped so as to have a curved central portion 11, a pair of lateral tongues 12 and 13 and an extension 14.

The frame 10 is suitable for mounting on a carriage 16 which is movable, in a known manner, parallel to a printing platen 17 carrying a recording medium 18. This medium 18 may be constituted by single sheets of paper, continuous forms, cheques or banking forms.

Figure 1:
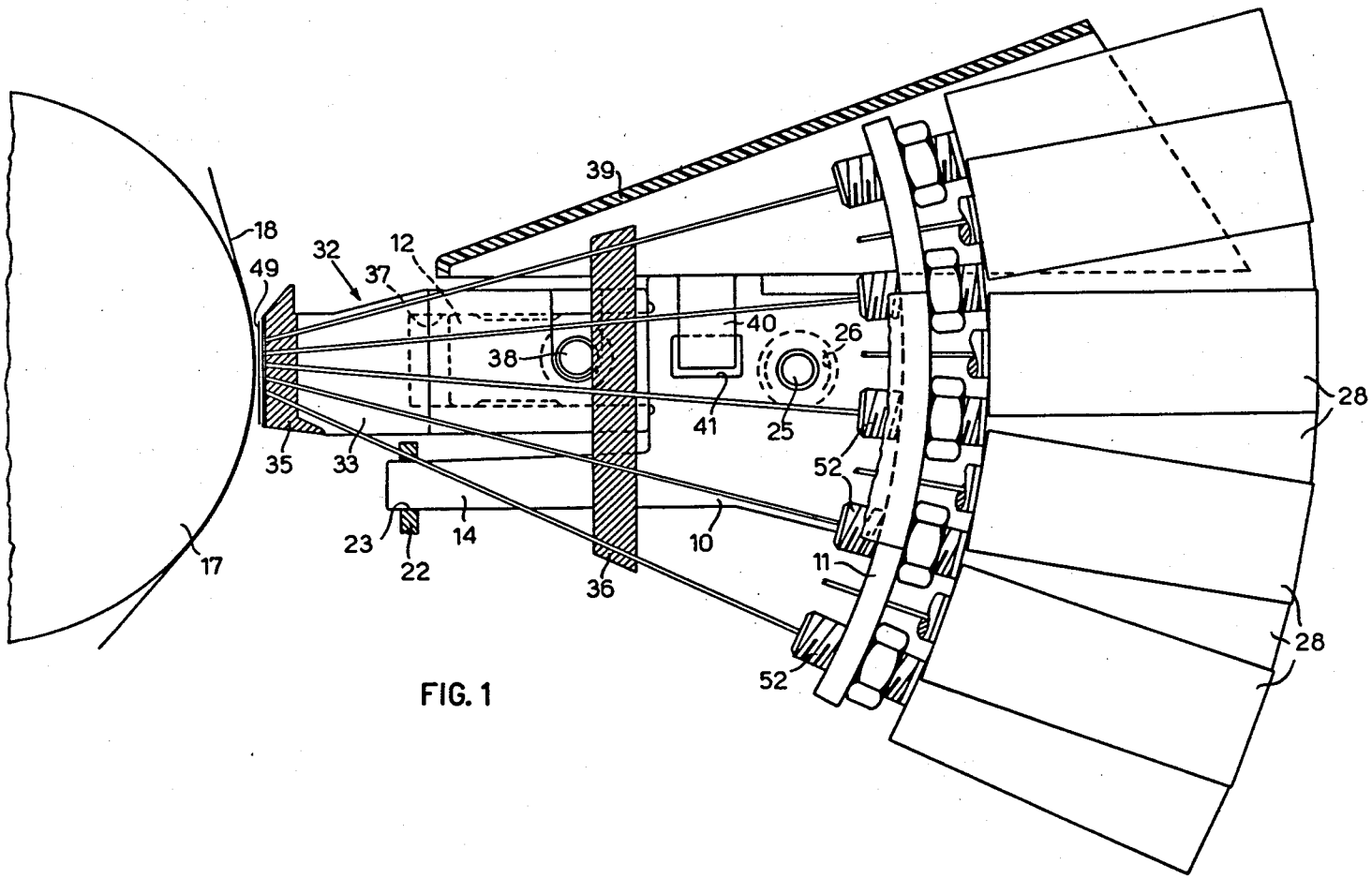
FIG. 1 is a lateral, partially cross sectional view of the wire printing device according to the invention.
Figure 2:
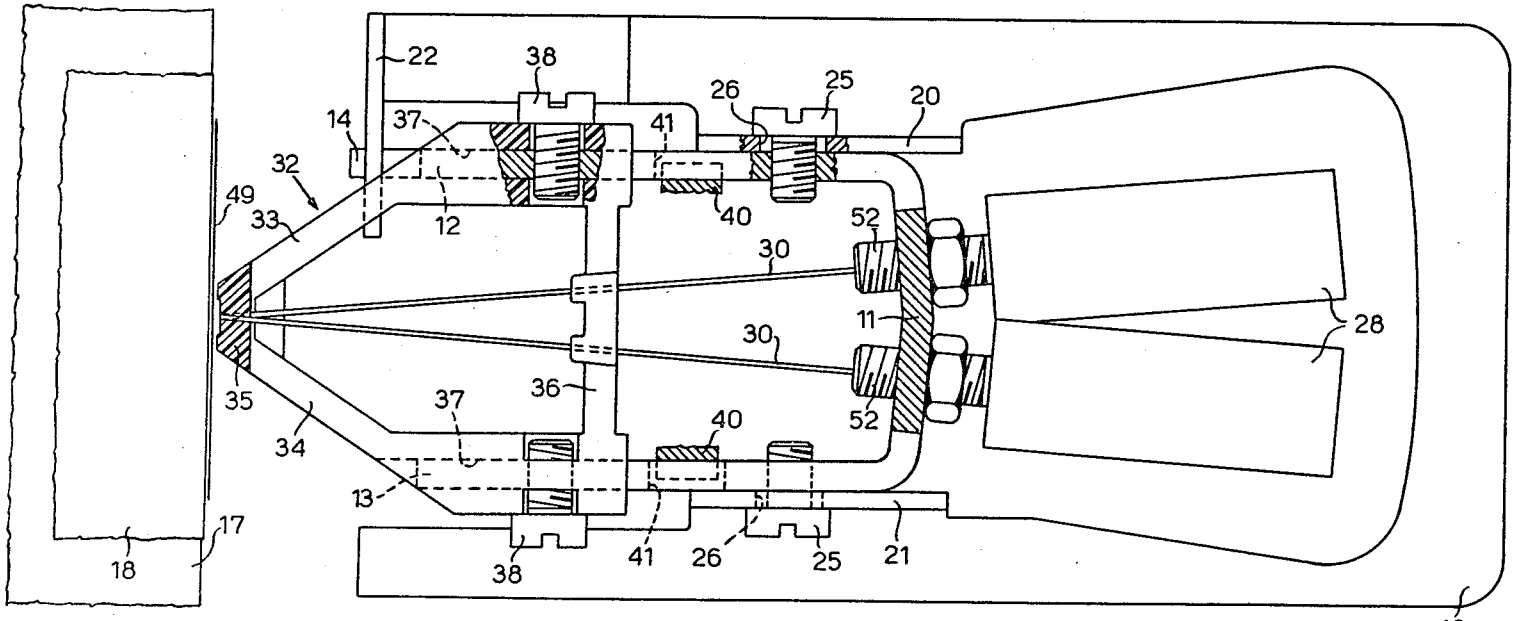
FIG. 2 is a planar, partially cross-sectional view of the device of FIG. 1.

The carriage 16 has two mutually parallel lateral sides 20 and 21 transversal to the platen 17, and a rear tongue 22 (on the left in FIG. 2) parallel to the platen 17.

The frame 10 is mounted on the carriage 16 by inserting the extension 14 into a slot 23 of the tongue 22, and is locked by two screws 25 passing through corresponding holes 26 of the sides 20 and 21.

A group of seven or nine electromagnets 28 is mounted on the central portion 11 of the frame 10, each driving a corresponding printing wire 30. The electromagets 28 are arranged in two adjacent vertical rows, mutually out of phase, and are screwed into corresponding threaded holes in the central portion 11 of the frame 10 such that they all converge on the printing line of the platen 17.

Figure 3:
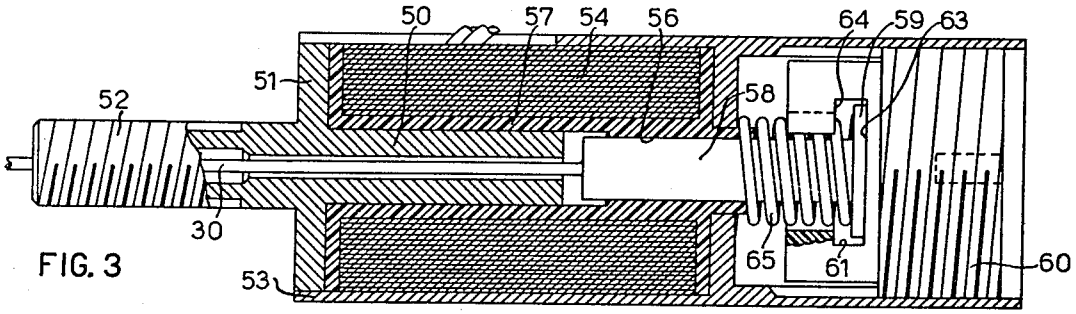
FIG. 3 is an enlarged, cross-sectional detail of the device of FIG. 1.

Each electomagnet 28 (FIG. 3) comprises a magnetic circuit formed by a cylindrical central stem made of material of high magnetic permeability, having a disk 51 in its central zone and a part 52, externally threaded and screwed into the corresponding threaded hole of the frame 10. The disk 51 is fixed to an outer casing 53 also made of material having high magnetic permeability and substantially tubular in shape. An excitation coil 54 is located inside the casing 53 and is wound on a plastic core having a through-hole 56. An armature 58 is slidably mounted inside the hole 56 to which a printing wire 30 is fixed. The armature 58 is substantially cylindrical in shape and carries at one end a disk 59. A plastic closing stopper 60 is screwed on the fore part of the casing 53 (on the right in FIG. 3), and has a groove 61 in which the disk 59 of the armature 58 is housed. The disk 59 is movable between the inner surfaces 63 and 64 of the groove 61, and is normally held against the surface 63 by a helicoidal spring 65 mounted coaxially to the armature 58. In particular, the distance between the inner surfaces 63 and 64 of the groove 61 is equal to the thickness of the disk 59 plus the stroke of the armature 58 with respect to the stem 50.

The wires 30 are guided by a guiding element 32 constituted by a plastic block shaped in manner that to have two lateral sides 33 and 34 and two transversal ribs 35 and 36. In particular, the wires 30 in proximity of their printing end are guided by the rib 35, and by the rib 36 in an intermediate zone between the printing ends and the electromagnets 28.

The guiding element 32 has on each lateral side 33,34 a slot 37 into which the corresponding tongue 12 and 13 of the frame 10 is inserted. The element 32 is fixed to the frame 10 by screws 38.

An upper plastic cover 39 has two lower tongues 40, which clip into corresponding slots 41 of the frame 10.

The parts of the printing device herein before described are assembled in the following manner.

Preliminarily, the printing wires 30 and corresponding electromagnets 28 are assembled. The core 57 and the corresponding coil 54 are arranged in the casing 53, and the stem 50 is then inserted in the hole 56; finally, the disk 51 is fixed to the casing 53. Separately, the armature 58, already fixed to the wire 30, the stopper 60 and the spring 65 are assembled, lodging the disk 58 in the groove 61.

The wire 30 and the armature 58 are inserted in the hole 56 from the front end of the frame 53, until the wire 30 protrudes from the rear part 52 of the stem 50, and the stopper is then screwed on the casing 53. In particular, whilst screwing the stopper 60 onto the casing 53, the wire 30 is drawn backwards (on the left in FIG. 3), in manner that whilst screwing, the disk 59 is kept pressing against the surface 64 of the groove 61. The stopper 60 is tightened until the front end of the armature 58 touches the inside part of the stem 50. The stopper 60 is then locked in this position.

In this way, the gap at rest between the armature 58 and the stem 50 is regulated. In fact, once the wire 30 is released, the spring 65 forces the armature 58 rightwards until the disk 59 comes to a stop against the hindering surface 63; since, as already mentioned, the distance between the surfaces 63 and 64 is equal to the thickness of the disk 59 plus the stroke of the armature 58, the armature 58 positions itself at a predetermined distance from the stem 50.

Separately, the block 32 is mounted on the supporting frame 10, inserting the lateral tongues 12 and 13 into the corresponding slots 36 and locking with the screws 38.

Once having assembled the frame 10 and the block 32, the electromagnets 28 are mounted by screwing their threaded parts 52 into the corresponding holes of the central portion 11, until the printing wires 30, guided by the guiding element 32, are aligned in front of the platen 17.

The printing head so assembled is then mounted on the carriage 16 by inserting the extension 14 into the slot 23 of the tongue 22 and the screws 25 into the holes 26 of the tongues 20 and 21.

Before locking the screws 25, the printing head is correctly positioned with respect to the planten 17.

A mounting of this type allows the distance between the printing head and the platen to be easily regulated, even by the user; in fact, it is sufficient to loosen the screws 25 in order to move the frame 10 with respect to the underlying carriage 16.

The printing device according to the invention functions in a known manner by displacement of the carriage 16 parallel to the platen 17, and by selective activation of the electromagnets 28 which cause the printing wires 30 to transfer ink from a ribbon 49, interposed between the printing ends of the wires and the platen 17, onto the recording medium 18, thus obtaining the printing of characters in the form of a dot matrix.

It is obvious that parts may be modified or added to the device without departing from the scope of the present invention.

We claim:

1. A wire printing device comprising a base member, a plurality of actuatable printing wires slidably mounted on said base member, and a plurality of driving electromagnets mounted on said base member for individually actuating said printing wires, wherein each one of said driving electromagnets comprises a magnetic circuit having a fixed central core, an excitation coil, an armature movable with respect to said fixed core and connected with a corresponding one of said printing wires and means for regulating the gap between said armature and said core leaving unaltered the stroke of said armature with respect to said core, said regulating means comprising an element screwable with respect to said fixed core having a first and a second shoulder between which said armature is movable.

2. A wire printing device according to claim 1, wherein said armature comprises a cylinder coaxial to said core and a disk fixed at one end of said cylinder, wherein said disk is interposed between said first and said second shoulder of said screwable element, and wherein the distance between said shoulders is equal to the thickness of said disk plus the stroke of said armature with respect to said core.

3. A wire printing device according to claim 2, wherein said shoulders are constituted by the inner walls of a groove of said screwable element.

4. A wire printing device according to claim 1, further comprising spring means for normally keeping said armature arrested against said first shoulder and for restoring said armature after the excitation of said coil.

5. A wire printing device comprising a base member, a plurality of actuatable printing wires slidably mounted on said base member, a plurality of driving electromagnets mounted on said base member for individually actuating said wires, and a guiding element mounted on said base member for guiding said wires, wherein each one of said driving electromagnets comprises a magnetic circuit having a fixed central core, an excitation coil, an armature movable with respect to said fixed core and connected with a corresponding one of said printing wires and means for regulating the gap between said armature and said core, leaving unaltered the stroke of said armature with respect to said core, said means comprising an element screwable with respect to said fixed core having a first and a second shoulder between which said armature is movable, and wherein said base member is constituted by a single plate, having a substantially constant thickness, and folded in order to have a central portion upon which said electromagnets are mounted, and at least a first lateral tongue which supports said guiding element.

* * * * *